US006578886B1

(12) United States Patent
Bystry et al.

(10) Patent No.: US 6,578,886 B1
(45) Date of Patent: Jun. 17, 2003

(54) SELF-LOCKING WIRE SEAL

(75) Inventors: Jerry A. Bystry, Orland, IN (US); Eric K. Hamilton, Fort Wayne, IN (US)

(73) Assignee: Brammall, Inc., Angola, IN (US)

( * ) Notice: Subject to any disclaimer, the term of this patent is extended or adjusted under 35 U.S.C. 154(b) by 0 days.

(21) Appl. No.: 09/399,530

(22) Filed: Sep. 20, 1999

(51) Int. Cl.[7] ..... B65D 33/34
(52) U.S. Cl. ..... 292/307 R; 292/315
(58) Field of Search ..... 292/307 A, 307 B, 292/307 R, 315, 321, 323, 525; 24/132 R, 132 AA, 115 A

(56) References Cited

U.S. PATENT DOCUMENTS

| | | | | | |
|---|---|---|---|---|---|
| 830,565 | A | * | 9/1906 | Brown | 292/307 R |
| 918,570 | A | * | 4/1909 | Mather | 292/318 |
| 968,665 | A | * | 8/1910 | Humphrey | 292/307 R |
| 2,809,065 | A | * | 10/1957 | Erke | 292/307 |
| 3,556,575 | A | | 1/1971 | Farkas | |
| 3,770,307 | A | * | 11/1973 | Van Gompel | 292/307 R |
| 3,875,618 | A | | 4/1975 | Schuplin | |
| 3,966,247 | A | | 6/1976 | Muller, Jr. et al. | |
| 4,326,740 | A | | 4/1982 | Guiler | |
| 4,498,507 | A | | 2/1985 | Thompson | |
| 4,500,124 | A | | 2/1985 | Swift | |
| 4,600,220 | A | | 7/1986 | Agnelli | |
| 4,640,538 | A | * | 2/1987 | Brammall | 292/323 |
| 4,681,355 | A | * | 7/1987 | Brammall | 292/323 |
| 5,125,700 | A | * | 6/1992 | Fattori | 292/318 |
| 5,193,251 | A | | 3/1993 | Fortsch | |
| 5,222,776 | A | * | 6/1993 | Georgopoulos | 292/323 |
| 5,402,958 | A | | 4/1995 | Mahaney | |
| 5,513,421 | A | | 5/1996 | Wells | |
| 5,517,728 | A | | 5/1996 | Woods | |
| 5,544,391 | A | | 8/1996 | Hoffman | |
| 5,547,344 | A | | 8/1996 | Sugiyama et al. | |
| 5,568,951 | A | * | 10/1996 | Morgan | 292/307 A |
| 5,582,447 | A | | 12/1996 | Leon et al. | |
| 5,647,620 | A | * | 7/1997 | Kuenzel | 292/317 |
| 5,762,386 | A | | 6/1998 | Fuehrer | |
| 5,781,975 | A | | 7/1998 | Wells et al. | |
| 5,815,891 | A | | 10/1998 | Students et al. | |
| 5,871,243 | A | | 2/1999 | Wenk | |
| 6,000,736 | A | * | 12/1999 | Leon | 292/326 |
| 6,131,969 | A | * | 10/2000 | Natkins | 292/323 |

FOREIGN PATENT DOCUMENTS

| | | | |
|---|---|---|---|
| EP | 0 861 994 A2 and A3 | 9/1998 | F16G/11/14 |
| FR | 973 370 | 10/1948 | |
| FR | 2740595 | 4/1997 | |
| GB | 1 376 912 | 12/1974 | |

OTHER PUBLICATIONS

European Search Report for Application No. EP 00 65 0127 completed on Apr. 24, 2001.
Eurasian (EAPO) Search Report, Sep. 1999.

* cited by examiner

*Primary Examiner*—Gary Estremsky
(74) *Attorney, Agent, or Firm*—Van Dyke, Gardner, Linn & Burkhart, LLP

(57) ABSTRACT

A self-locking wire seal includes a body in which one end of a wire is fixedly secured. The free end of the wire can be inserted through the hasp of a lock. The free end of the wire is then inserted through a channel in the body of the seal. The wire contacts a locking mechanism which automatically prevents the retraction of the wire out of the channel defined in the body. The locking mechanism may comprise a spring which engages notches defined on the wire. The notches may be defined by using a concentrically laid spiral wound wire. The spring flexes out of the way of these notches when inserted, but grips the wire when attempts are made to retract the wire from the body of the seal.

28 Claims, 5 Drawing Sheets

SELF-LOCKING WIRE SEAL

BACKGROUND OF THE INVENTION

This invention relates generally to tamper-evident seals, and more particularly to wire seals.

Prior art locking seals generally come in two types: strap seals and wire seals. Strap seals generally include a flat, typically plastic or metal strap which is inserted through the hasp of a lock. The strap end is then inserted into the seal body where it cannot be removed. An example of such a strap seal is disclosed in U.S. Pat. No. 5,513,421 issued to Wells. One of the disadvantages of strap seals is that the strap has a relatively large dimension, as compared to a wire. The strap typically is flat and includes a pair of broadly planar surfaces. Such seals cannot be used in locks having hasps of a relatively narrow aperture. Such locks require the use of a seal having a wire or other relatively narrow, elongated member.

Prior art wire seals, however, have suffered from the disadvantage that they require multiple steps to use. For example, one prior art wire seal is disclosed in U.S. Pat. No. 5,402,958 issued to Mahaney. The wire seal disclosed therein first requires the wire to be inserted into an aperture defined in the seal. After this a plug must be rotated in the seal. The use of the seal thus requires two steps: insertion and rotation. Another such example is U.S. Pat. No. 5,762,386 issued to Fuehrer. This patent discloses a tamper resistant seal in which a wire must first be wrapped around an insert. The insert is then inserted into a receptacle from which it cannot be removed. Not only does this require multiple steps, but maintaining the wire around the insert while simultaneously inserting it into the receptacle requires a certain amount of dexterity and coordination.

The desirability can therefore be seen of a self-locking wire seal which is simple to use and which eliminates the multi-step requirements of prior art wire seals.

SUMMARY OF THE INVENTION

Accordingly, the present invention provides a self-locking wire seal which can be operated with only a single step. The seal is both easy to use and economical to manufacture and provides all the benefits associated with prior art wire seals.

A self-locking wire seal according to one aspect of the present invention includes a body and a spiral wound wire which has a first end secured to the body. A channel is defined in the body and is sufficiently large to receive a second end of the spiral wound wire. A lock is positioned inside of the body adjacent the channel and is adapted to contact the spiral wound wire when it is inserted in the channel. The lock allows the wire to be inserted but not retracted from the channel.

According to another aspect of the present invention, a self-locking seal includes a body, a flexible, elongated member, and a channel defined in the body. An interior space is also defined in the body and in communication with the channel. A spring is housed in the interior space of the body. The spring includes a sidewall, a base wall, and a flexible arm. The sidewall is oriented generally parallel to the channel while the base wall is oriented generally perpendicular to the channel. The flexible arm is oriented at an angle with respect to the base wall and extends partially into the channel. The base wall includes an aperture in alignment with the channel. When the flexible, elongated member is inserted through the channel and the aperture, it is prevented from being removed from the channel by the flexible arm of the spring.

According to another aspect of the present invention, a self-locking seal includes a body having a plurality of sides. The body includes a first channel and a second channel. The first channel extends out of one of the plurality of sides of the body while the second channel extends through said body from one side to an opposite side of the body. A chamber is also defined in the body and is in communication with the first channel. A slug is provided and is dimensioned to fit within the chamber. A wire is secured to the slug and extends out of the body through the first channel. A spring is housed within the body and extends at least partially into the second channel. The spring is flexible enough to be pushed out of the channel when the wire is inserted into the second channel in a first direction. The spring is also oriented at an angle in the second channel such that the spring grips the wire when the wire is retracted in the second channel in a second direction opposite the first direction.

According to yet another aspect of the invention, a method of sealing an object having an opening includes providing a seal body having a metal wire secured thereto. The metal wire has a free end which is unsecured to the seal body. A channel is defined within the body and a flexible spring is provided within the body. The flexible spring extends at least partially into the channel and is oriented to grip the metal wire when the metal wire moves through the channel in a first direction. The flexible spring flexes out of the way of the metal wire when the wire is moved through a channel in a second direction opposite said first direction. The free end of the metal wire is inserted through the opening in the object and subsequently inserted until the free end moves past the flexible spring.

In use, the self-locking wire seal of the present invention involves only the single step of inserting the wire into a channel in the body. The insertion of the wire self locks the wire in the channel of the body. No extra steps of twisting or inserting are required. These and other benefits, results and objects of the present invention will be apparent to one skilled in the art, in light of the following specification when read in conjunction with the accompanying drawings.

DETAILED DESCRIPTION OF THE PREFERRED EMBODIMENTS

Figure 1:
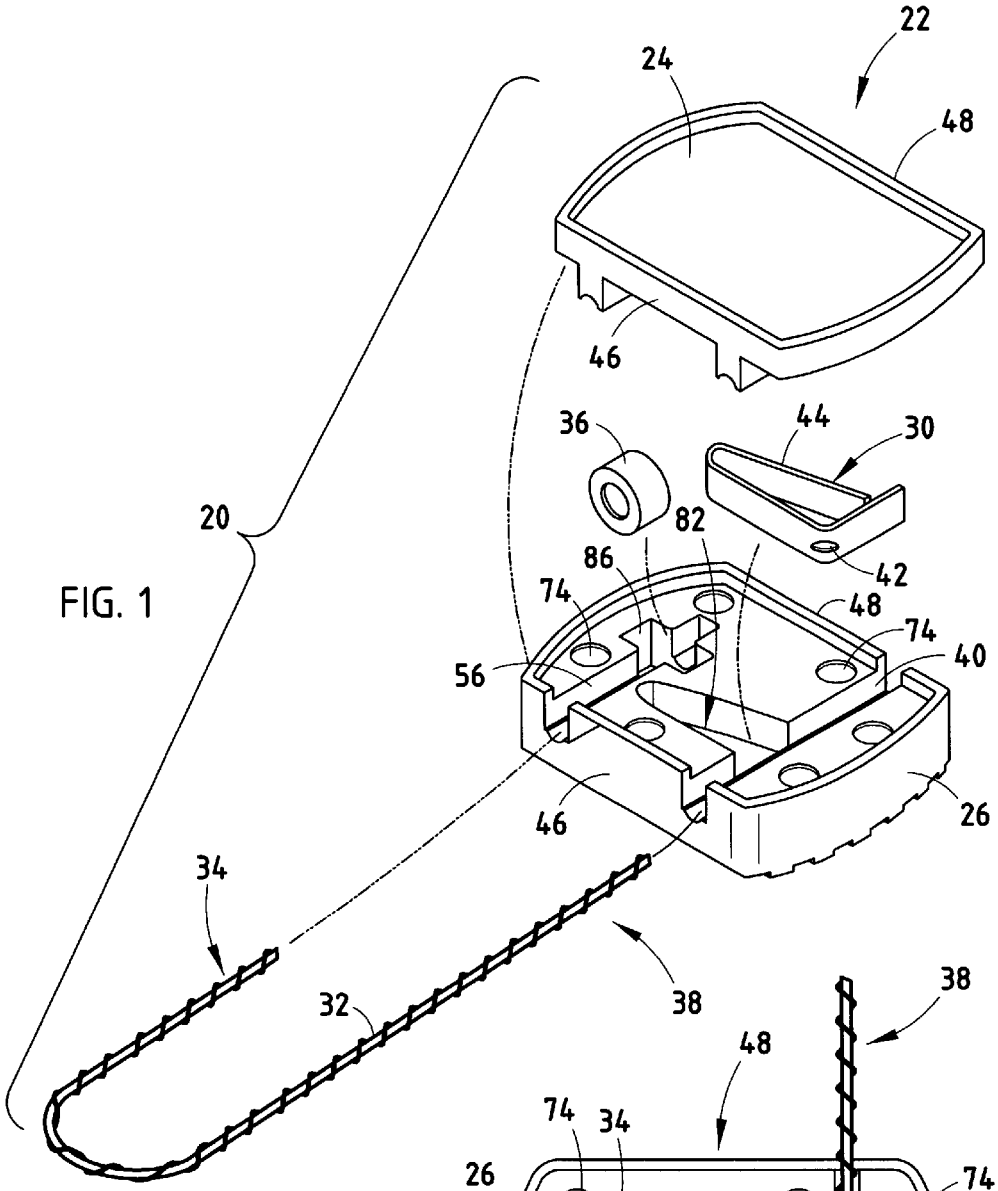
FIG. 1 is an exploded, perspective view of a self-locking wire seal according to a first embodiment of the present invention.
Figure 2:
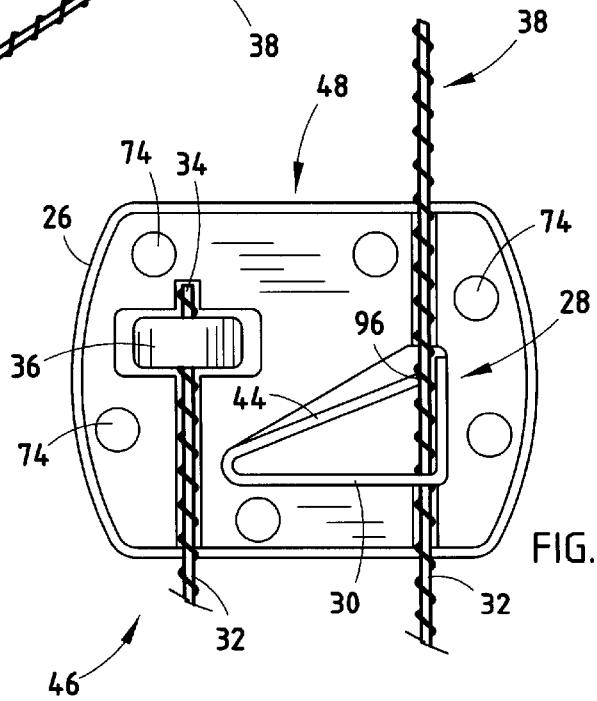
FIG. 2 is a plan view of the first embodiment of the self-locking wire seal shown with a first half of the body removed and the wire inserted into the seal.
Figure 4:
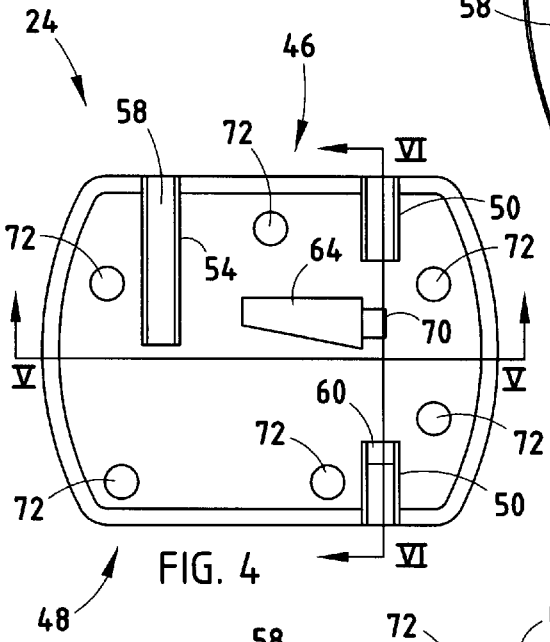
FIG. 4 is a plan view of the first half depicted in FIG. 3.

The present invention will now be described with reference to the accompanying drawings wherein like reference numerals correspond to like elements in the several drawings. A self-locking wire seal 20 is depicted in FIG. 1 in unassembled form. Self-locking wire seal 20 includes a body 22 having a first and second half 24 and 26, respectively. A lock 28, which in this case comprises a spring 30, is housed between first and second halves 24 and 26 of body 22. A spiral wound wire 32 is secured at a first end 34 to a slug 36. Slug 36 is sandwiched between first and second halves 24 and 26 of body 22. Slug 36 retains first end 34 of spiral wound wire 32 in body 22. When seal 20 is to be used, a second, free end 38 of wire 32 is inserted into a channel 40 defined in body 22. Channel 40 intersects a portion of spring 30 and is generally aligned with an aperture 42 defined in spring 30. During the manufacturing process, first and second halves 24 and 26 are secured together and enclose spring 30 and slug 36. In order to operate self-locking wire seal 20, second end 38 of wire 32 is inserted into channel 40 past spring 30. When wire 32 first contacts a flexible arm 44 of spring 30, flexible arm 44 is moved out of the way of wire 32. Wire 32 can therefore be inserted past flexible arm 44. Wire 32, however, cannot be retracted out of channel 40 because of the gripping of wire 32 by flexible arm 44. Specifically, flexible arm 44 fits under an edge of the spiral windings of spiral wound wire 32. The spiral winding contacts flexible arm 44 and prevents wire 32 from being retracted. In this way, seal 20 is self-locking and only requires the insertion of wire 32 into channel 40.

Figure 3:
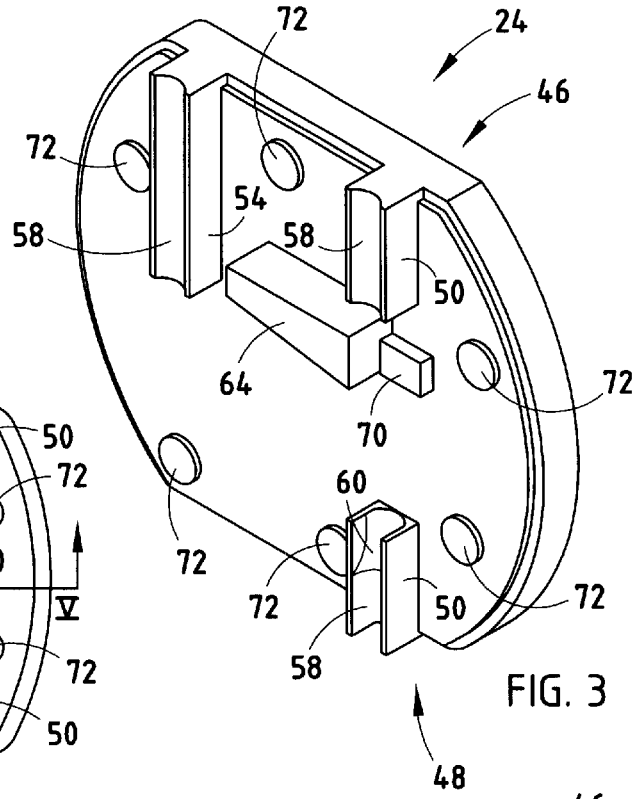
FIG. 3 is a perspective view of the first half of the self-locking wire seal.
Figure 5:
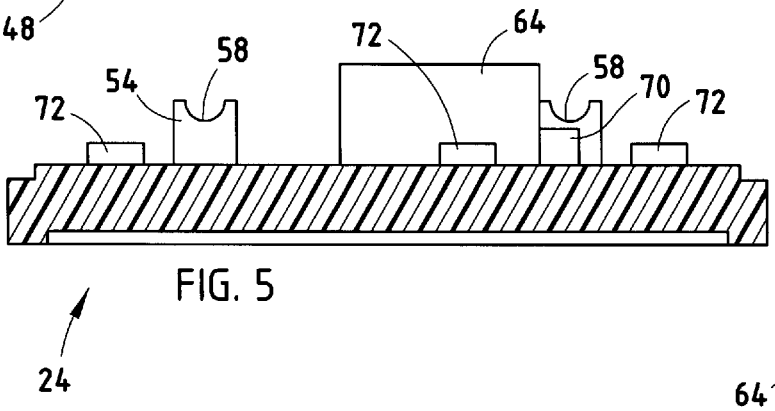
FIG. 5 is a sectional view of the first half of the seal taken along the line V—V of FIG. 4.
Figure 6:
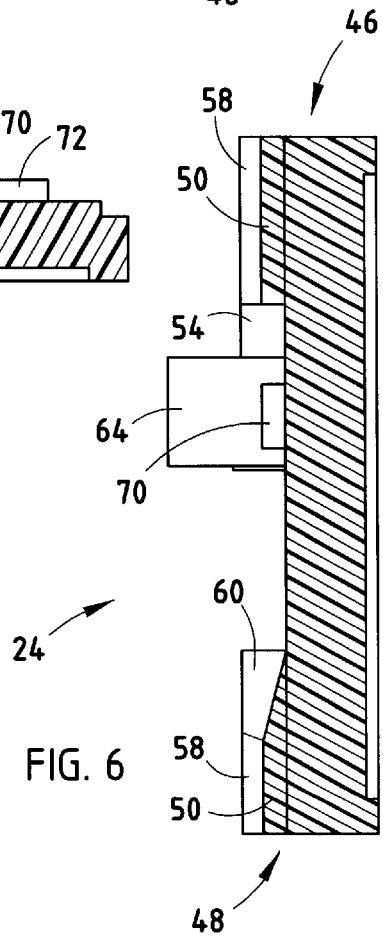
FIG. 6 is a sectional view taken along the line VI—VI of FIG. 4.

First half 24 of body 22 is preferably made of plastic, although other materials could be used. First half 24 includes a first side 46 and second side 48. First half 24 further includes three channel-defining protrusions (FIGS. 1–6). The first and second channel protrusions 50 partially define first channel 40 in body 22 (see FIGS. 1 and 2). A third channel protrusion 54 partially defines a second channel 56 in body 22 and is, in the current embodiment, oriented generally parallel to first channel 40. As can be seen, first channel 40 extends from first side 46 to second side 48 of first half 24. Second channel 56 extends into the interior of first half 24, but does not extend completely through first half 24. Protrusions 50 and 54 include a generally semi-circular surface 58 which is positioned along corresponding semi-circular surfaces on second half 26 to thereby define first and second channels 40 and 56. Wire 32 fits through first and second channels 40 and 56. As shown in FIG. 3, first channel protrusion 50 includes a sloped surface 60. When spiral wound wire is inserted into first channel 40, it is inserted through first side 46 of body 22. It passes through the portion of first channel 40 defined by second channel protrusion 50. It then passes through a trapezoidal space 82 where lock 28 is positioned. Finally, it passes into the portion of first channel 40 defined by first channel protrusion 50. Sloped surface 60 helps ensure that wire 32 is properly guided into the portion of first channel 40 defined by first channel protrusion 50. Thereafter, wire 32 exits out of second side 48 of body 22.

First half 24 further includes a trapezoidal block 64 which is defined generally between first and second channel protrusions 50. Trapezoidal block 64 fits into the interior space 66 of spring 30 (see FIGS. 11–12). Trapezoidal block is dimensioned somewhat smaller than interior space 66 to allow a certain degree of flexing of flexible arm 44 of spring 30. Trapezoidal block 64, however, limits the flexing of flexible arm 44 toward a base wall 68 of spring 30. Trapezoidal block 64 locates base wall 68 of spring 30, and prevents base wall 68 from moving upon insertion of wire 32. A block extension 70 is defined adjacent trapezoidal block 64 and helps guide wire 32 through first channel 40.

First half 24 further includes six circular bonding areas 72. Bonding areas 72 project outwardly from first half 24 body 22. Bonding area 72 are used in securing first half 24 to second half 26 of body 22. While a wide variety of different methods can be used to secure these two halves together, in the current embodiment, first and second halves 24 and 26 are ultrasonically welded together.

Figure 7:
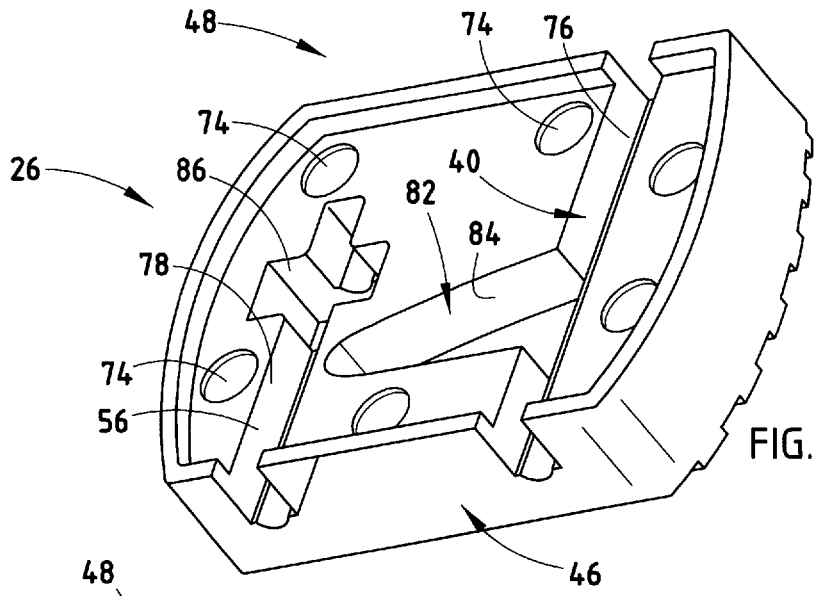
FIG. 7 is a perspective view of a second half of the first embodiment of the wire seal.
Figure 8:
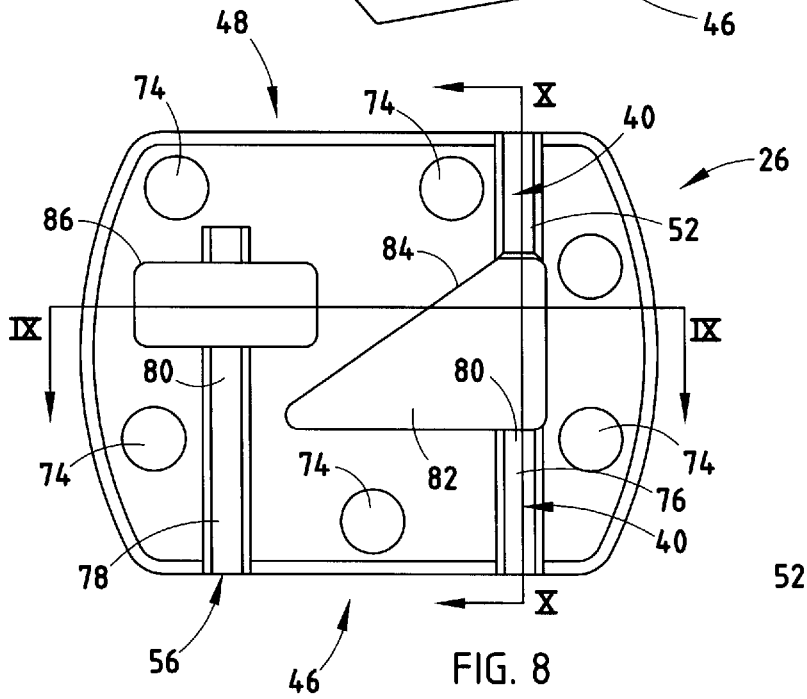
FIG. 8 is a plan view of the second half of the wire seal of FIG. 7.
Figure 9:
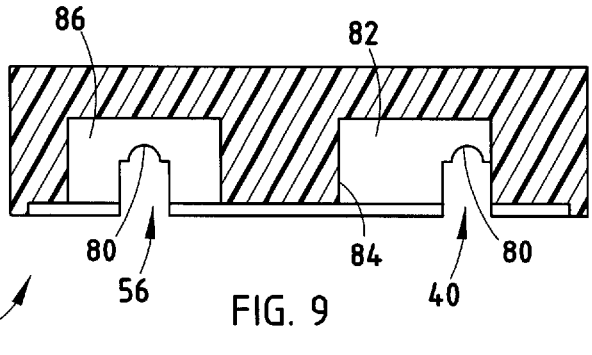
FIG. 9 is a sectional view taken along the line IX—IX of FIG. 8.
Figure 10:
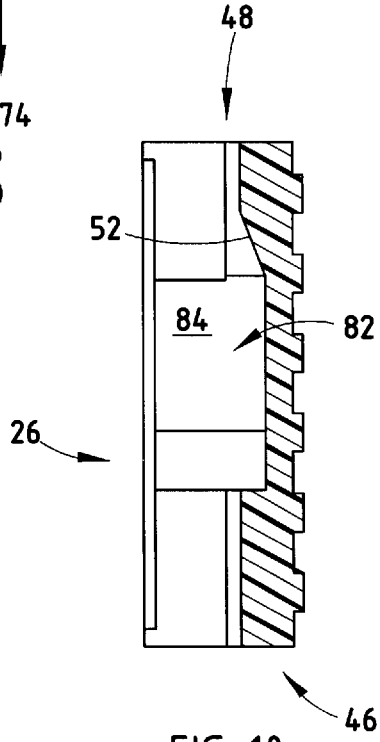
FIG. 10 is a sectional view taken along the line X—X of FIG. 8.

FIGS. 7–10 depict second half 26 of body 22. As can be seen in FIGS. 7 and 8, second half 26 includes six bonding depressions 74 which receive the bonding protrusions 72 on first half 24. Second half 26 further includes recesses 76 and 78 which receive first, second, and third channel protrusions 50 and 54 from first half 24. Recesses 76 and 78 include a semicircular surface 80 which aligns with semicircular surface 58 when first and second halves 24 and 26 are secured together. When semicircular surfaces 80 and 58 abut each other, they define first and second channels 40 and 56. Second half 26 further includes a trapezoidal recess 82 which accommodates spring 30. An angled portion 52 (FIGS. 8 and 10) of semicircular surface 80 is located adjacent trapezoidal recess 82 and helps guide wire 32 into channel 40 after it is threaded past spring 30. Trapezoidal recess 82 includes an angled wall 84 which has a greater angle than the unflexed angle of flexible arm 44 of spring 30. When spring 30 is inserted into trapezoidal recess 82, a space is therefore created between angled wall 84 and flexible arm 44. The space allows flexible arm 44 to flex out of the way of wire 32 when it is inserted into first channel 40.

Second half 26 further includes a slug recess 86 positioned toward the end of second channel 56. Slug recess 86 is dimensioned to accommodate slug 36 (FIGS. 1, 13, and 14) that is fixedly secured to first end 34 of spiral wound wire 32. Slug 36 secures first end 34 of wire 32 internally in body 22 of seal 20.

Figure 11:
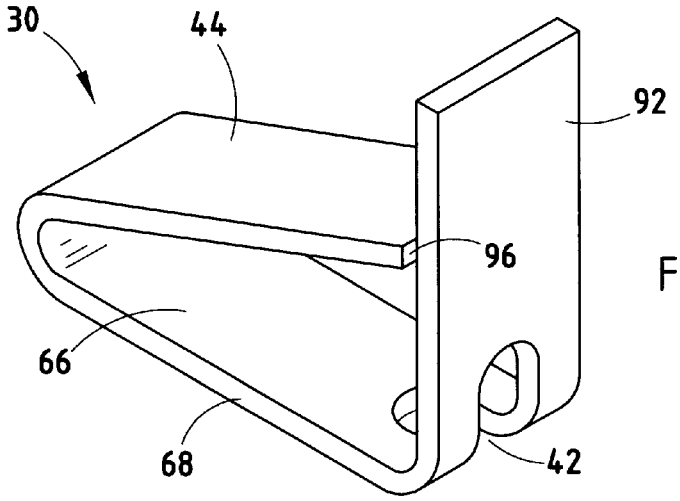
FIG. 11 is a perspective view of a spring.
Figure 12:
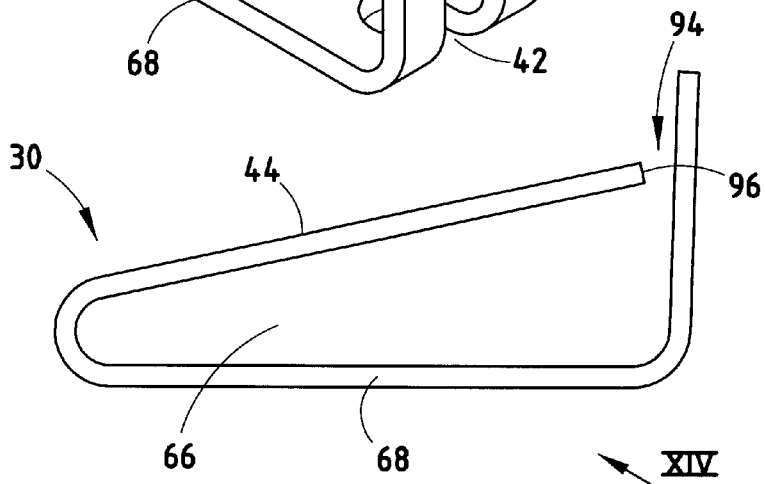
FIG. 12 is an elevational view of the spring of FIG. 11.

Spring 30 includes, in addition to flexible arm 44, base wall 68 and sidewall 92. Base wall 68 and sidewall 92 are oriented generally perpendicular to each other (FIGS. 11 and 12). Flexible arm 44 extends at an angle from base wall 68 toward sidewall 92. Flexible arm 44, however, does not reach entirely to sidewall 92, but instead terminates adjacent thereto and defines a gap 94 between sidewall 92 and flexible arm 44. Gap 94 is where wire 32 fits when inserted into seal 20.

Figure 13:
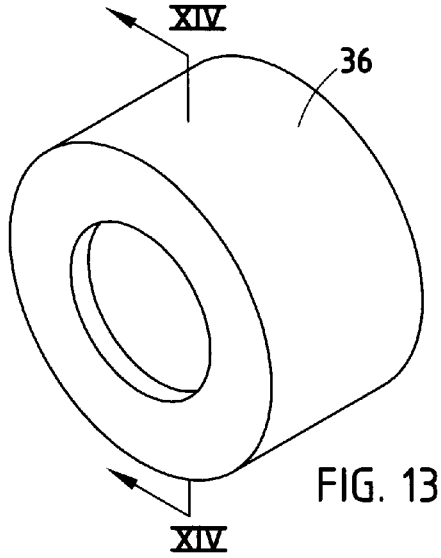
FIG. 13 is a perspective view of a slug.
Figure 14:
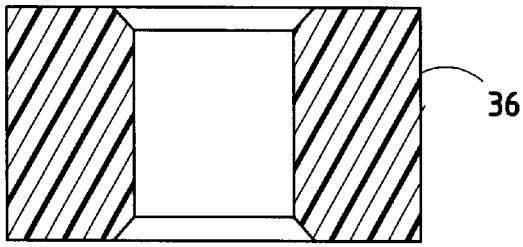
FIG. 14 is an elevational, sectional view of the slug of FIG. 13.

Slug 36 is depicted in FIGS. 13 and 14 and is attached by any conventional means to first end 34 of wire 32. Slug 36 is made of metal in the current embodiment, but could be made of any suitable material. Slug 36 prevents first end 34 of wire 32 from being removed from the body 22 of wire seal 20.

Figure 15:
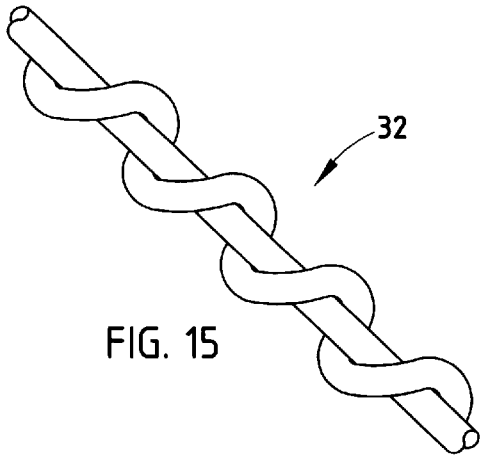
FIG. 15 is a perspective view of a concentrically laid, spiral wound wire.

A section of spiral wound wire 32 is depicted in FIG. 15. Spiral wound wire 32 is a conventional wire that is commercially available from a variety of sources. In the current embodiment, spiral wound wire is a concentrically laid stainless steel wire that has eight wrappings per inch of wire. Of course it will be understood that different numbers of wrappings per inch can be used within the scope of the invention. The spiral wrapping on wire 32 provides a series of notches which engage an edge 96 of spring 30 and thereby prevent wire 32 from being retracted out of seal 20. In the current embodiment, the main wire of spiral wound wire 32 has a diameter of 0.019 inches, while the spiral wire has a diameter of 0.016 inches. Wires with other dimensions can of course be used. During the course of manufacture, the ends the wire are fused together, i.e., welded. This welding of the two wire elements allows a rounded finish which eases insertion and serves to keep the assembly together under physical stress. The terminal weld also serves to indicate that the seal is as it came from the factory. A cut, sharp end would indicate the possibility of tampering.

Figure 16:
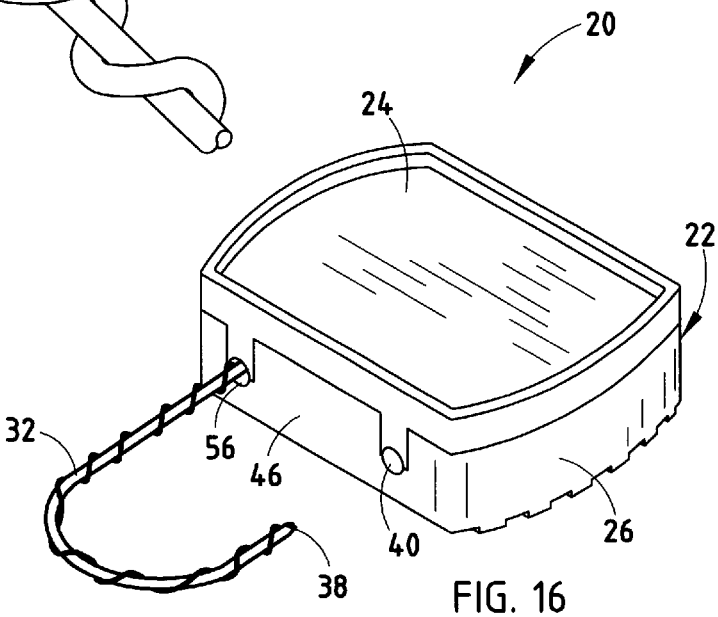
FIG. 16 is a perspective view of the assembled first embodiment of the wire seal.

FIG. 16 depicts an assembled self-locking wire seal 20 according to one embodiment of the current invention. Prior to use, second end 38 of wire 32 is not inserted into second channel 56 of body 22. When used, second end 38 of wire 32 is first inserted through the hasp of the lock, or other looping structure, which is desired to be secured. Second end 38 of wire 32 is then inserted into second channel 56 past spring 30. Once wire 32 is inserted past spring 32, the spiral wound nature of wire 32, in combination with edge 96 of flexible arm 44, prevents wire 32 from being retracted out of the body of the seal. Typically wire 32 is inserted fully into second channel 56 until the loop formed by wire 32 is as small as possible. In this manner, any tampering with the lock secured by seal 20 is detectable. If the loop is left too large, then it is possible to cut wire 32 and reinsert the cut end into second channel 56 and thereby avoid detection of tampering.

Figure 17:
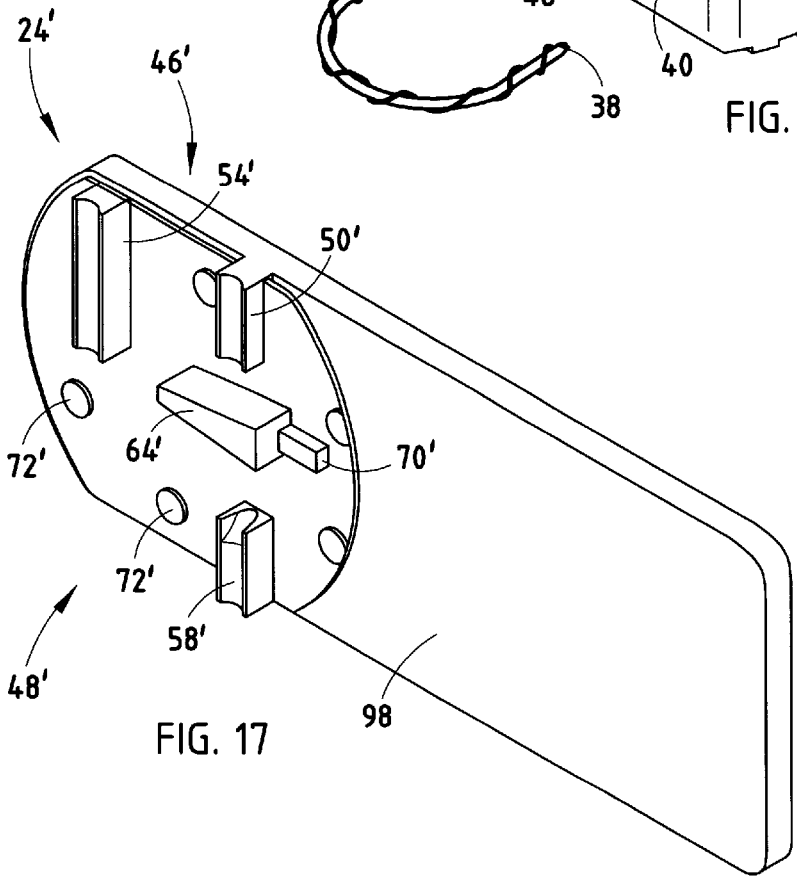
FIG. 17 is a first half of a wire seal according to a second embodiment of the present invention.

FIG. 17 depicts a first half 24' according to a second embodiment of the present invention. First half 24' differs from the first embodiment in that it includes an elongated section or tag 98. First half 24' is joined to a second half that is the same as second half 26 of the first embodiment. When joined together, the seal 20' operates in the same manner as seal 20 of the first embodiment. Tag 98 of first half 24' provides a highly visible area for stamping a unique serial number associated with the particular seal. In this way, a seal cannot simply be cut and replaced with another seal without being detected. Such a serial number can also be stamped onto first half 24, although it does not have as highly a visible section as elongated section 98.

While the present invention has been described in terms of the preferred embodiments discussed in the above specification, it will be understood by one skilled in the art that the present invention is not limited to these particular preferred embodiments, but includes any and all such modifications which are in the spirit and scope of the present invention as defined in the appended claims.

The embodiments of the present invention in which an exclusive property or privilege is claimed are defined as follows:

1. A self-locking seal, comprising:

a body;

a spiral wound wire having a first and a second end, said first end secured to said body, said spiral wound wire comprising a first, single-stranded generally non-wound wire and a second, single-stranded wire wound about said first wire, said second wire being wound about and in contact with said first wire in such a manner as to define a series of notches on the external surface of said spiral wound wire, said notches being defined by spaces between windings of said second wire;

a channel defined in said body, said channel being sufficiently large to receive said second end of said spiral wound wire;

a lock positioned adjacent said channel, said lock adapted to contact said spiral wound wire and allow said wire to be inserted into said channel and past said lock but prevent said wire from being retracted from said channel through said lock, said lock preventing said wire from being retracted from said channel by being inserted into at least one of the notches defined on the external surface of said spiral wound wire.

2. A self-locking seal, comprising:

a body;

a spiral wound wire having a first and a second end, said first end secured to said body, said spiral wound wire comprising a first, generally non-wound wire and a second wire wound about said first wire;

a channel defined in said body, said channel being sufficiently large to receive said second end of said spiral wound wire;

a lock positioned adjacent said channel, said lock comprising a spring having an edge that contacts said spiral wound wire, said lock adapted to contact said spiral wound wire and allow said wire to be inserted into said channel and past said lock but prevent said wire from being retracted from said channel through said lock.

3. The self-locking seal of claim 2 wherein said edge is dimensioned to fit between spirals on said spiral wound wire.

4. The self-locking wire seal of claim 3 wherein said spring includes a flexible arm on which said edge is defined, said flexible arm sufficiently flexible to alternately position said edge in said channel and sufficiently out of said channel to allow said spiral wound wire to be inserted into said channel.

5. The self-locking seal of claim 4 wherein said spring is biased to maintain said edge in said channel.

6. The self-locking seal of claim 2 wherein said spring comprises a base wall and a flexible arm on which said edge is defined, said flexible arm oriented at an acute angle with respect to said base wall, said flexible arm flexible with respect to said base wall wherein said edge of said flexible wall can be flexed into and out of said channel.

7. The self-locking seal of claim 6 wherein said spring further includes a side wall oriented generally perpendicular to said base wall, said base wall defining an aperture positioned in said channel and dimensioned to receive said spiral wound wire.

8. The self-locking seal of claim 1 wherein said body defines an interior chamber and a second channel having a cross-sectional area, said interior chamber being in communication with said second channel, said chamber having a greater cross sectional area than said second channel and dimensioned to receive a slug secured to said first end of said spiral wound wire whereby said first end of said spiral wound wire is secured to said body by way of said slug positioned in said chamber.

9. The self-locking seal of claim 1 wherein said body comprises a first and a second half which are fixedly secured together prior to inserting said second end of said wire into said channel.

10. The self-locking seal of claim 9 wherein said first and said second half of said body are configured to define a space for said lock when said first and said second half are secured together.

11. The self-locking seal of claim 9 wherein said first and second half of said body are made of plastic and are ultrasonically welded together.

12. The self-locking seal of claim 1 wherein said spiral wound wire has a cross-sectional width of less than 0.1 inch.

13. A self-locking seal, comprising:

a body having first and second sides;

a flexible, elongated member secured to said body;

a channel defined in said body, said channel extending from said first to said second side;

an interior space defined in said body and in communication with said channel; and a spring housed in said interior space, said spring including a side wall oriented generally parallel to said channel, a base wall oriented generally perpendicular to said channel, and a flexible arm oriented at an angle to said base wall and extending partially into said channel, said base wall defining an aperture in alignment with said channel whereby said flexible, elongated member is inserted through said channel and said aperture and is prevented from being removed from said channel by said flexible arm, said flexible arm urging said flexible member against said sidewall when attempts are made to remove said flexible member from said channel.

14. The self-locking seal of claim 13 wherein said flexible, elongated member includes notches which are selectively engaged by said flexible arm.

15. The self-locking seal of claim 14 wherein said flexible, elongated member is a spiral wound wire and said notches are defined by the spirals wound on said wire.

16. A self-locking seal, comprising:

a body having first and second sides;

a flexible, elongated member secured to said body;

a channel defined in said body, said channel extending from said first to said second side;

an interior space defined in said body and in communication with said channel; and a spring housed in said interior space, said spring including a side wall oriented generally parallel to said channel, a base wall oriented generally perpendicular to said channel, and a flexible arm oriented at an angle to said base wall and extending partially into said channel, said base wall defining an aperture in alignment with said channel whereby said flexible, elongated member is inserted through said channel and said aperture and is prevented from being removed from said channel by said flexible arm, wherein said body extends between said flexible arm and said base wall such that said body limits the amount of flexing of said flexible arm toward said base wall.

17. The self-locking seal of claim 13 wherein said body comprises a first half and a second half which are secured together.

18. The self-locking seal of claim 17 wherein said spring is housed between said first and second halves of said body.

19. The self-locking seal of claim 17 wherein said flexible, elongated member is secured to said body by a slug housed between said first and second halves of said body.

20. A self-locking seal, comprising:

a body having a plurality of sides, said body defining a first channel and a second channel, said first channel extending out of one of said plurality of sides, said second channel extending through said body from one of said plurality of sides to an opposite one of said plurality of sides;

a chamber defined in said body and in communication with said first channel;

a slug dimensioned to fit within said chamber;

a wire secured to said slug and extending out of said body through said first channel;

a spring housed within said body and extending at least partially into said second channel, said spring being flexible enough to be pushed out of said channel when said wire is inserted into said second channel in a first direction, said spring being oriented at an angle in said second channel such that said spring grips said wire when said wire is retracted in said second channel in a second direction opposite said first direction.

21. The self-locking seal of claim 20 wherein said wire is a spiral wound wire.

22. The self-locking seal of claim 21 wherein said spring grips said wire by engaging the spirals on said spiral wound wire.

23. The self-locking seal of claim 20 wherein said body comprises a first and a second half which are secured together.

24. The self-locking seal of claim 23 wherein said body is made of plastic and said first and second halves are ultrasonically welded together.

25. A method of sealing an object having an opening, comprising:

providing a seal body having a metal wire secured thereto, said metal wire having a free end, said metal wire also having a plurality of notches defined thereon;

providing a channel defined within said body;

providing a flexible spring within said body, said flexible spring extending at least partially into said channel, said flexible spring oriented to flex into one of said notches on said metal wire when moved through said channel in a first direction and to flex out of the way of said metal wire when moved through said channel in a second direction opposite said first direction, said flexible spring thereby preventing said flexible member from being moved out of said channel in said first direction;

inserting said free end of said metal wire through said opening in said object;

subsequently inserting said free end of said metal wire into said channel past said flexible spring.

26. The method of claim 25 further including inserting said free end of said metal wire further into said channel until said free end of said metal wire exits out of said channel.

27. The method of claim 25 wherein said plurality of notches on said metal wire are formed by a spiral wound metal wire.

28. The method of claim 25 wherein said spring includes a side wall oriented generally parallel to said channel, a base wall oriented generally perpendicular to said channel, and a flexible arm oriented at an angle to said base wall and extending partially into said channel, said base wall defining an aperture in alignment with said channel.

* * * * *